US005433092A

United States Patent [19]

Kuo

[11] Patent Number: 5,433,092

[45] Date of Patent: Jul. 18, 1995

[54] CUFF LOCK

[76] Inventor: Li-Tsao Kuo, No.47-8, Alley 36, Lane 459, Sec. 1, An Ho Rd., Tainan City, Taiwan

[21] Appl. No.: 159,290

[22] Filed: Nov. 30, 1993

[51] Int. Cl.[6] ..... E05B 67/12

[52] U.S. Cl. ..... 70/46; 70/18; 70/53

[58] Field of Search ..... 70/36, 39, 53, 20, 18, 70/27, 29, 41, 45, 48, 233, 234, 236, 237, 357, 490, 379 R, 209, 226, 46

[56] References Cited

U.S. PATENT DOCUMENTS

| | | | |
|---|---|---|---|
| 264,639 | 9/1882 | Donahue | 70/DIG. 36 |
| 288,559 | 11/1883 | Skala et al. | 70/27 |
| 574,961 | 1/1897 | Troast | 70/18 |
| 1,347,467 | 7/1920 | Scott et al. | 70/18 |
| 3,626,729 | 12/1971 | Fane et al. | 70/379 R |
| 4,192,161 | 3/1980 | Borlinghaus | 70/455 |
| 4,938,039 | 7/1990 | Tzung-i | 70/38 A |
| 5,040,388 | 8/1991 | Chen | 70/209 |
| 5,199,283 | 4/1993 | Chen | 70/209 |
| 5,230,231 | 7/1993 | Liou | 70/38 A |
| 5,259,222 | 11/1993 | Jang | 70/209 |

FOREIGN PATENT DOCUMENTS

| | | | |
|---|---|---|---|
| 505407 | 7/1920 | France | 70/20 |
| 346544 | 1/1922 | Germany | 70/36 |

*Primary Examiner*—Peter M. Cuomo
*Assistant Examiner*—Darnell M. Boucher
*Attorney, Agent, or Firm*—Morton J. Rosenberg; David I. Klein

[57] ABSTRACT

A cuff lock is provided. The cuff lock includes a pair of arcuate rod members having one end of each pivotally secured together. The opposing end of one rod member is affixed to a lock mechanism through a sleeve. The opposing end of the other rod member is releasably engaged by a rotatable latch of the lock mechanism through the sleeve.

3 Claims, 8 Drawing Sheets

CUFF LOCK

BACKGROUND OF THE INVENTION

1. Field of the Invention

This invention relates to a lock, more particularly, to a lock having a lock mechanism securely attached to one end of an arcuate rod member, and a reduced portion being formed at the end of another rod member adapted to be securely locked within the lock mechanism.

2. Prior Art

Locks have been widely utilized to secure bicycles, motorcycles, and the like, such as by a chain and padlock. Those locks are generally composed of a U-shaped bar member A, as shown in FIGS. 6 and 7, having one end of which is pivotally secured to one end of a lock housing and the other end of the rod member A1 being releasably secured to a lock mechanism A2 with a head portion A12 passing through an opening in the lock mechanism and having shoulder All lockingly engaged by an active latch element of the lock mechanism A2. This type of lock would have a hard time locking two bicycles together that are not parked on smooth ground, not parked on the same surface.

Other prior art locks are adapted for the same purpose, as shown in FIG. 8. Such include a pair of arcuate arms 1 having one end of each pivotally connected together. A hollow barrel B2 and a lock housing B1 are securely connected to the other end of the two arms B, respectively. A reduced portion B11 is formed at one end of the lock housing B1 and adapted to be received within the hollow barrel B2. The portion B11 has an aperture B11 formed in one side which is adapted to extend a latch B13 therefrom, the latch being controlled by a lock core B12 to move upwardly or downwardly to lock or to release the arms B. Such lock may easily be pried from the connecting end.

SUMMARY OF THE INVENTION

It is a primary object of the present invention to provide a cuff lock which includes a lock housing securely attached to one end of a rod member to lock an end of another rod member.

It is another object of the present invention to provide a cuff lock which is easy to operate.

It is a further object of the present invention to provide a cuff lock which is simple in construction and costs less to manufacture.

DETAILED DESCRIPTION OF THE PREFERRED EMBODIMENTS

Figure 1:
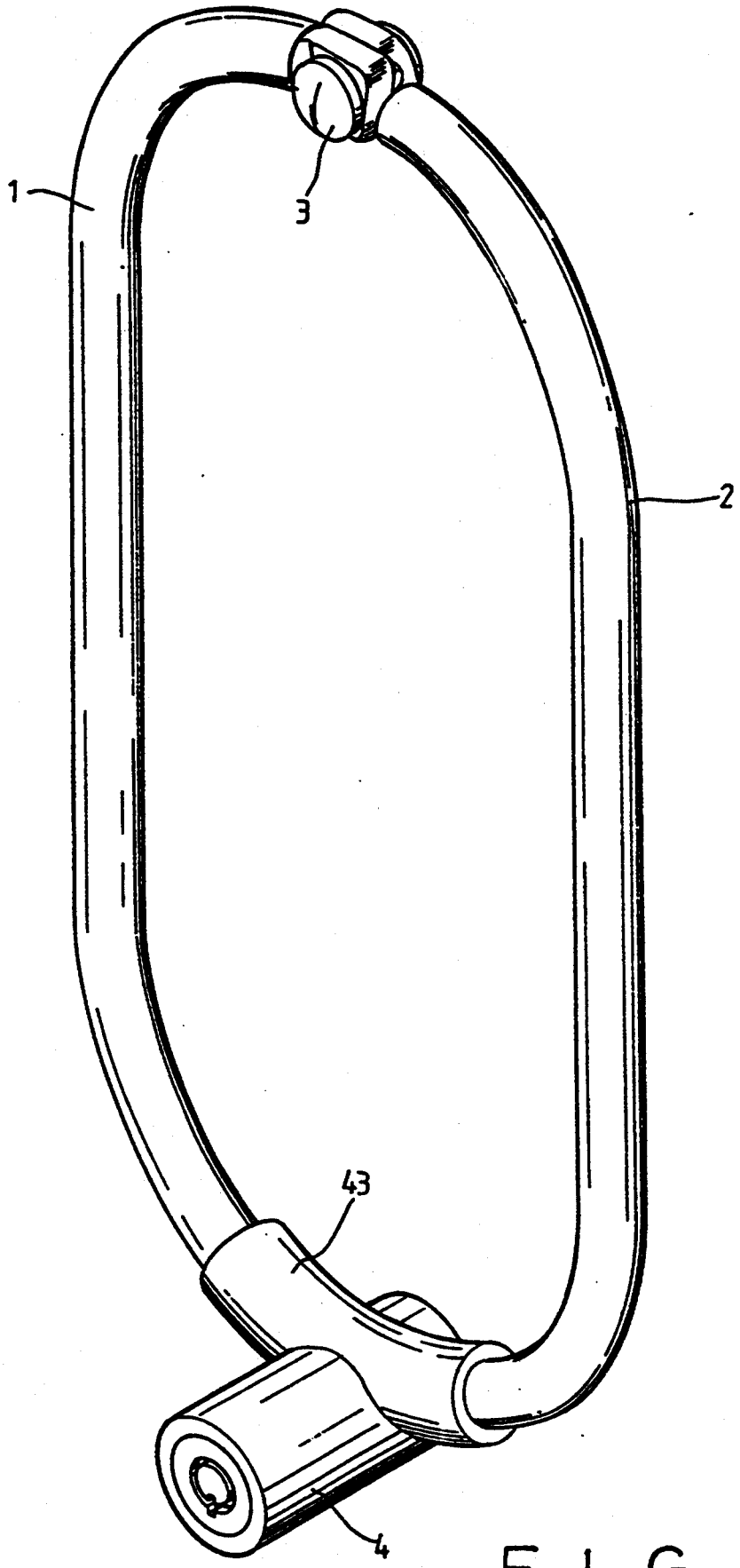
FIG. 1 is a perspective view of the present invention.
Figure 2:
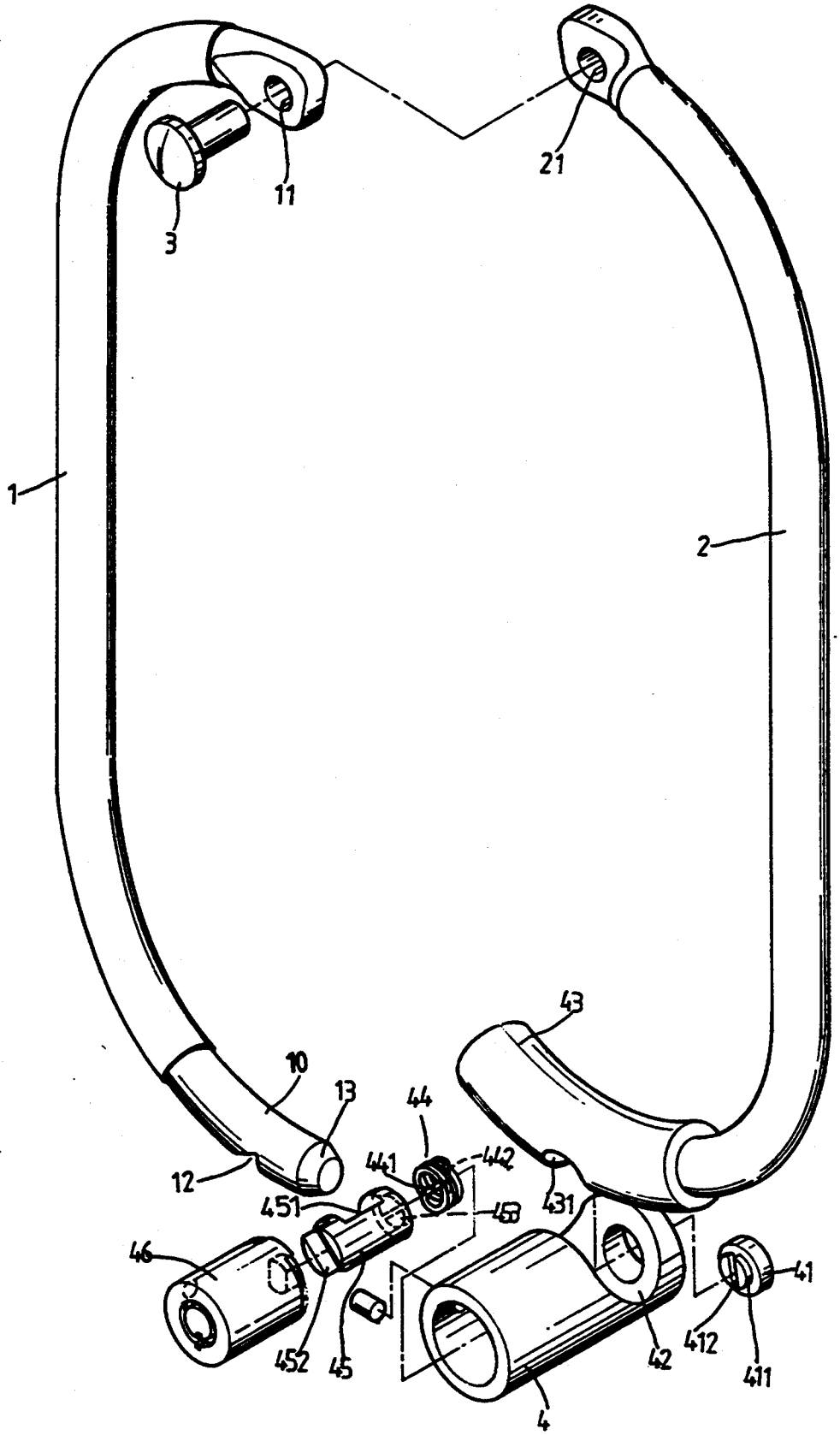
FIG. 2 is an exploded view of the present invention.
Figure 3:
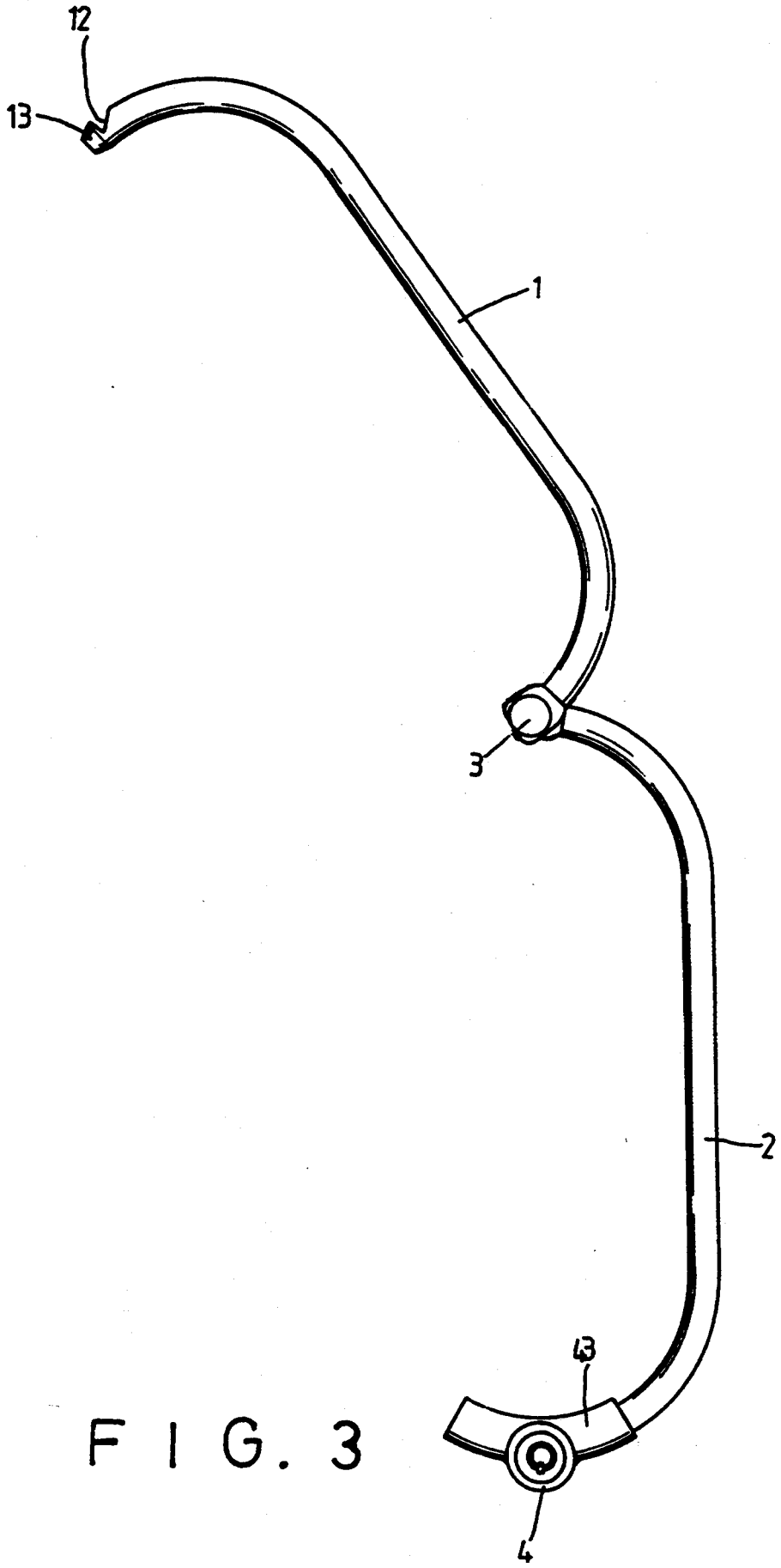
FIG. 3 is a plan view of the present invention in an unlocked condition.

Reference is now made to the drawings wherein each drawing is for the purpose of illustration only and not for the purpose of limiting the inventive concept. FIGS. 1 and 2 show a pair of arcuate first and second rod members 2 and 1 having one end of each pivotally secured together. A hollow resilient plastic material overlays a sleeve 43 having a notch 431 formed through one side thereof coupled to a portion of the free end of the first rod member 2, and is adapted to be received within the lock housing 4. The remaining portion of the sleeve 43 is left free to receive a reduced portion 10 at the free end of the second rod member 1 therein. The reduced portion 10 is formed at the free end of the second rod member 1, and is provided with an indentation 12 and a tapered end surface 13.

The lock housing 4 includes a passage extending axially and adapted to receive a lock core 46 therein. A notch 42 is formed transversely in the lock housing 4, and is interconnected with the axial passage. Notch 42 is adapted to provide solder joint connection with the sleeve 43, the notch 431 of the sleeve 43 being in communication with the axial passage. One end of the lock housing 4 has a smaller diameter which is adapted to receive a plug 41 which has a circular protuberance 411 protruding from the side thereof facing the lock housing 4. The protuberance 411 has a slot 412 at center portion thereof adapted to receive an arm 442 of a torque spring 4. The other arm 441 of the torque spring 44 is inserted into a slot 453 of a latch 45. Latch 45 includes a recessed portion 452 disposed at the opposite end of the slot 43. The recessed portion 452 of the latch 45 is linked to a lock core 46 to pivot, which is a well known art and therefore will not be described here.

The latch 45 includes a longitudinal trough 451 formed on one side of its body and adapted to confine the movement of the reduced portion 10 of second rod member 1 within the sleeve 43 when the lock is in a locked condition.

Figure 4A:
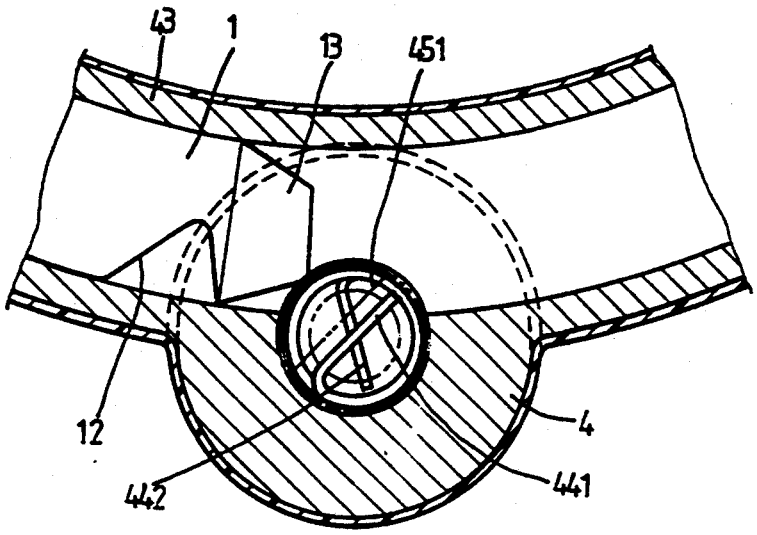
FIG. 4A is a side sectional view of the lock mechanism of the present invention showing the disengagement of a reduced portion and the lock core.
Figure 4B:
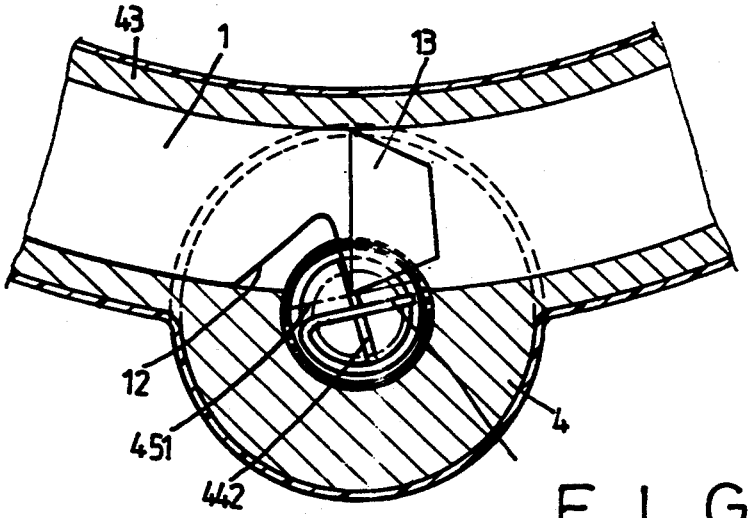
FIG. 4B is a side sectional view similar to that of FIG. 4A, showing the reduced portion pushing the lock core.
Figure 4C:
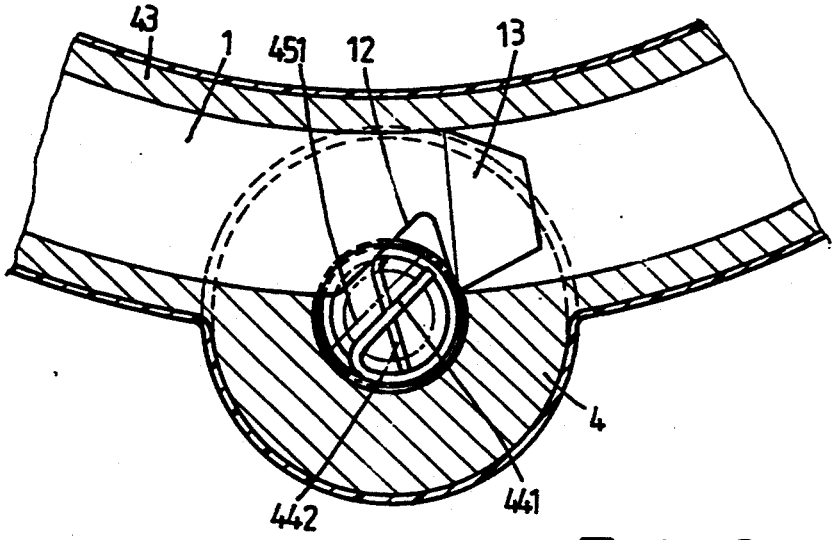
FIG. 4C is a further side sectional view similar to that of FIG. 4A, showing the present invention in a locked condition.

To operate the lock, the reduced end portion 10 of the second rod member 1 is inserted into the sleeve 43, as shown in FIG. 4A. The tapered end 13 of the reduced portion 10 will touch and push the trough 451 of the latch 45 in the same direction, as shown in FIG. 4B. It is to be noted that torque spring 44 provides a restoring force to the latch 45 to return it to its original position. Upon the indentation 12 reaching the trough 451, the torque spring 44 will urge the trough 451 to return to its original position, as shown in FIG. 4C. Thus, the lock will then be in a locked condition. To unlock the lock, simply insert a legal key through the key way of the lock core 46 and turn the key to rotate the latch 45 to a position where the trough 451 is aligned with the indentation 12. The second rod member 1 will then be able to be removed from the sleeve 43.

Figure 5A:
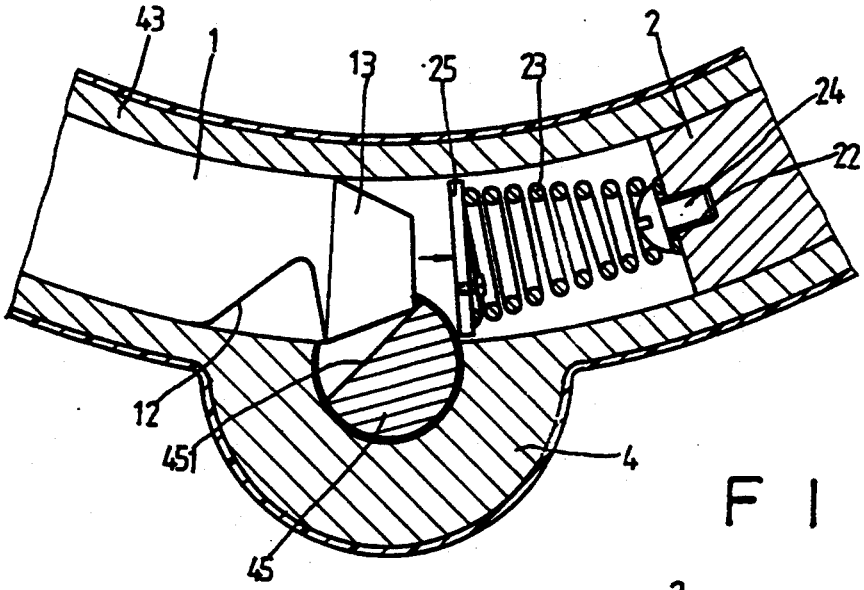
FIG. 5A is a side sectional view of a second embodiment showing the lock mechanism in an unlocked condition.
Figure 5B:
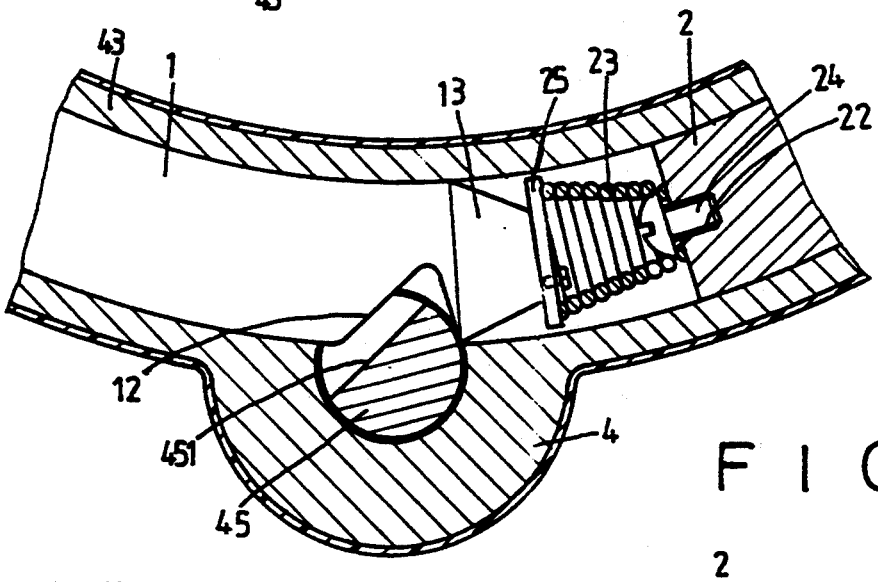
FIG. 5B is another side sectional view similar to that of FIG. 5A, showing the lock mechanism in a locked condition.
Figure 5C:
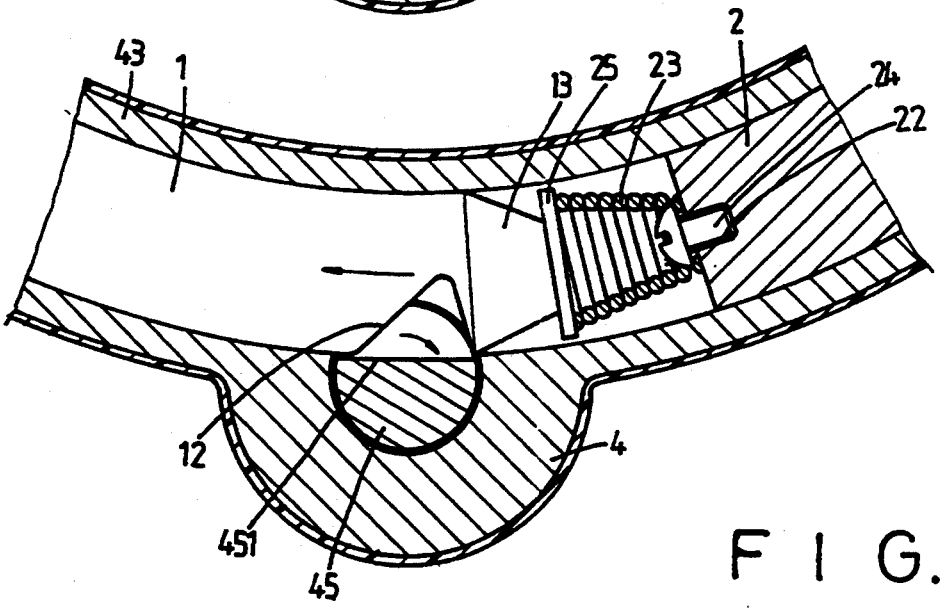
FIG. 5C is a further side sectional view similar to that of FIG. 5A, showing the lock mechanism in an unlocked condition.
Figure 6:
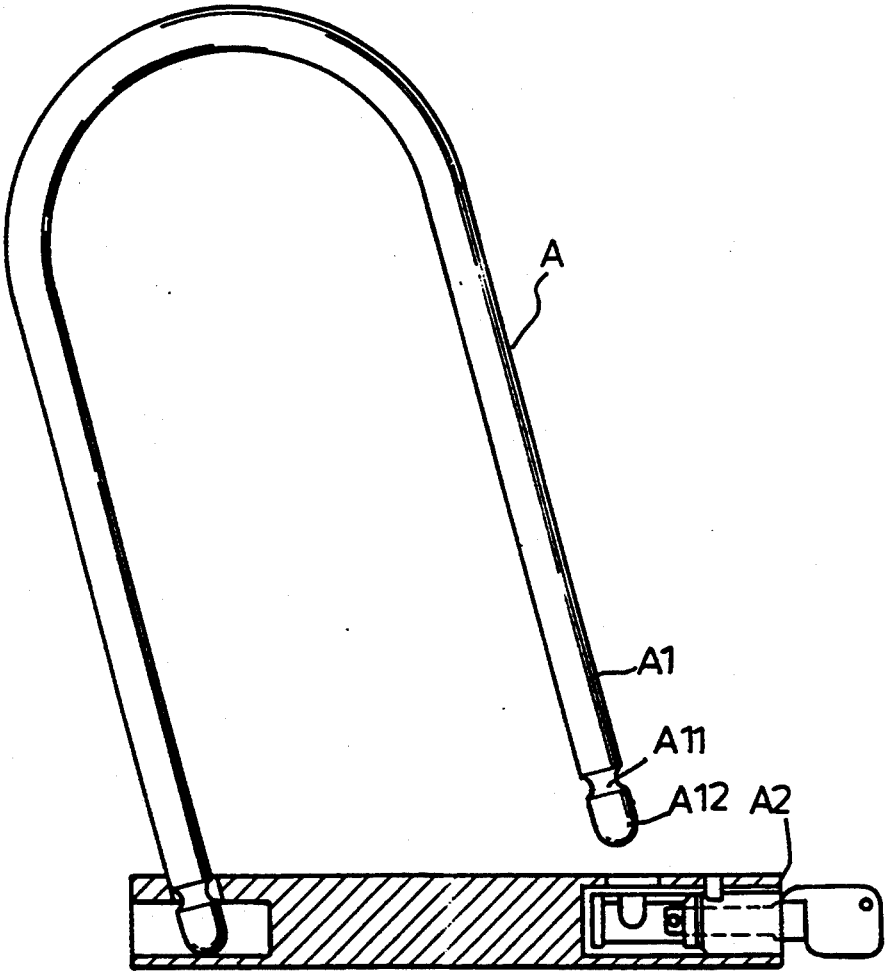
FIG.6 PRIOR ART
FIGS. 6, 7 and 8 are depictions of prior art locks.
Figure 7:
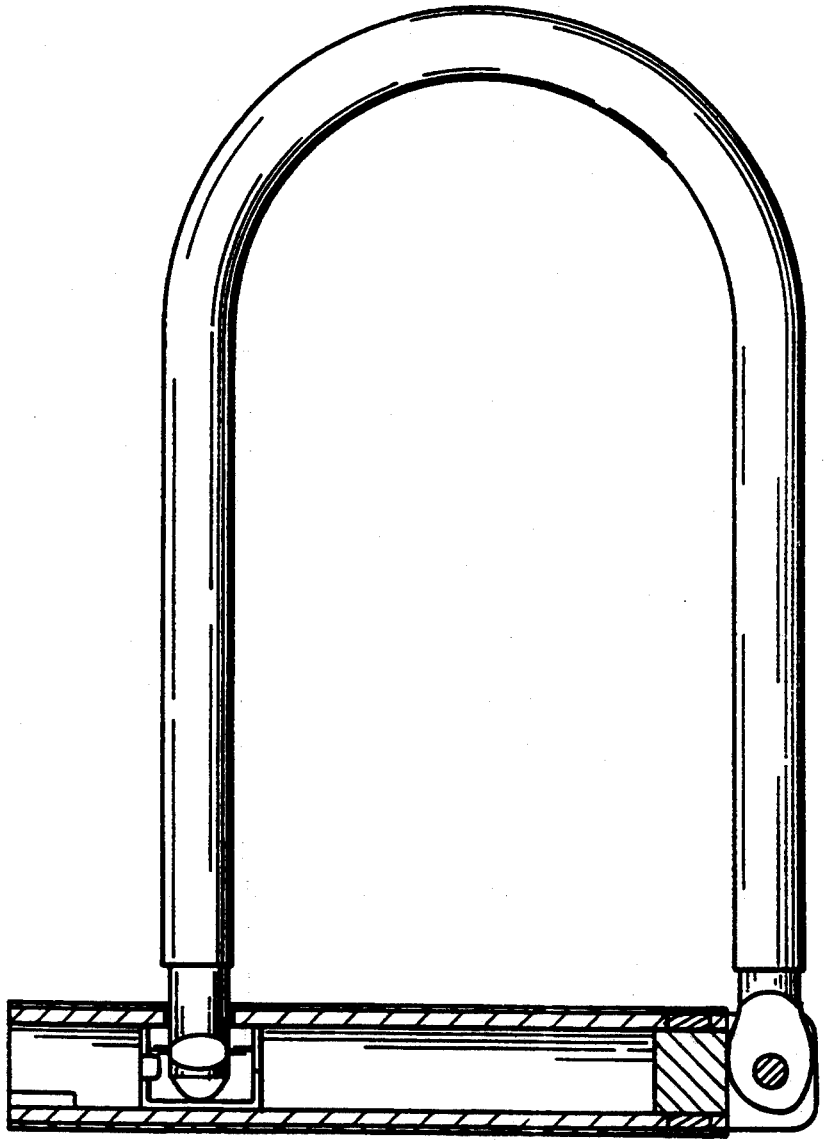
FIG.7 PRIOR ART
Figures 8, 8A:
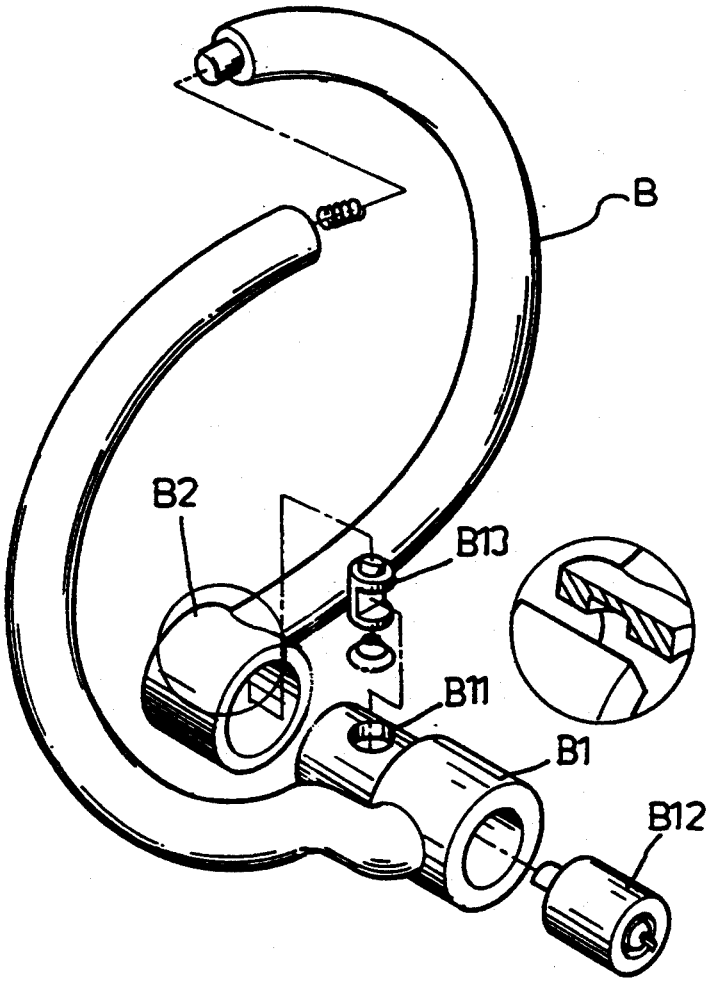
FIG. 8 PRIOR ART

A second embodiment is provided, as shown in FIG. 5A, which has a hole 22 formed in the end of the first rod member 2. A spring 23 has one end secured to the hole 22 by means of a bolt 24. The other end of the spring 23 is connected with a plate 25 and extends outwardly. By pushing the second rod member 1 toward the first rod member 2, the tapered end 13 will engage the trough 451 and thereby turn the trough 451. Upon the notch 12 reaching the trough 451, the trough 451 will return to its original position. The tapered end 13 will then be bearing against the spring 23, as shown in FIG. 5B. The spring 23 will urge the reduced end portion 10 of second rod member 1 outwardly when the trough 451 is rotated to be aligned with the notch 12, as shown in FIG. 5C, the second rod member 1 thereby being able to be removed from the sleeve 43.

I claim:

1. A cuff lock, comprising:

a lock housing formed by a longitudinally extended tubular wall member, said tubular wall member defining a central passage opening extending longitudinally between opposing first and second ends of said lock housing, said tubular wall member having a first notched opening extending in a direction transverse said longitudinal direction, said first notched opening being in open communication with said central passage;

a lock core secured within said first end of said lock housing, said lock core having a key receiving slot formed in a portion thereof adapted to be rotatably displaceable responsive to rotation of a proper key inserted into said key receiving slot;

a longitudinally extended latch member disposed within said central passage of said lock housing and coupled on a first end to said rotatable lock core portion for rotation therewith, said latch member having a transversely directed recess formed in one side thereof disposed in aligned relationship with said first notched opening in said tubular wall member, said latch member having a latch member section disposed adjacent said recess, said latch member having a first slotted opening formed in a second end thereof;

a plug member secured within said second end of said lock housing and forming a closure therefore, said plug member having a second slotted opening formed in one end thereof;

a torsion spring disposed between said second end of said latch member and said plug member, said torsion spring having first end engaged within said first slotted opening and a second end engaged within said second slotted opening for providing a rotational bias force to said latch member;

a tubular sleeve member having a through bore extending between opposing first and second ends thereof, said tubular sleeve member having a second notched opening formed intermediate said tubular sleeve member first and second ends in open communication with said through bore, said tubular sleeve member being affixed to said lock housing in said transverse direction within said first notched opening, said through bore intersecting with said central passage of said lock housing for reversible rotative displacement of said latch member section into said through bore;

a first rod member having a first end secured within said through bore from said first end of said tubular sleeve member; and, a second rod member having a first end pivotally coupled to a second end of said first rod member, said second rod member having a second end adapted to be slidingly received within said through bore from said second end of said tubular sleeve member, said second end of said second rod member having recess formed therein for locking engagement with said latch member section when said latch member section is displaced into said through bore.

2. The cuff lock as recited in claim 1, further comprising a spring member disposed within said through bore and having one end coupled to said first end of said first rod member, an opposing end of said spring member being compressively displaced by said second end of said second rod member for applying a bias force thereto.

3. The cuff lock as recited in claim 2, further comprising a plate member coupled to said opposing end of said spring member for providing a contact surface with said second end of said second rod member.

* * * * *